US008197772B2

(12) United States Patent
Sim et al.

(10) Patent No.: US 8,197,772 B2
(45) Date of Patent: Jun. 12, 2012

(54) BIOCHIP PACKAGE BODY, METHOD OF FORMING THE SAME, AND BIOCHIP PACKAGE INCLUDING THE BIOCHIP PACKAGE BODY

(75) Inventors: Tae-Seok Sim, Yongin-si (KR); Dong-Ho Lee, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 158 days.

(21) Appl. No.: 12/559,789

(22) Filed: Sep. 15, 2009

(65) Prior Publication Data

US 2010/0068101 A1 Mar. 18, 2010

(30) Foreign Application Priority Data

Sep. 16, 2008 (KR) ..... 10-2008-0090750

(51) Int. Cl.
*B01L 3/00* (2006.01)

(52) U.S. Cl. ..... 422/503; 422/50; 422/68.1; 422/502; 422/547; 422/554; 422/560; 422/561; 436/43

(58) Field of Classification Search ..... 422/50, 422/68.1, 502, 503, 547, 554, 560, 561; 436/43
See application file for complete search history.

(56) References Cited

U.S. PATENT DOCUMENTS

| | | | | |
|---|---|---|---|---|
| 4,439,918 | A * | 4/1984 | Carroll et al. | 29/840 |
| 5,945,334 | A * | 8/1999 | Besemer et al. | 435/287.2 |
| 6,410,309 | B1 * | 6/2002 | Barbera-Guillem et al. | 435/297.5 |
| 6,509,636 | B1 | 1/2003 | Tsai et al. | |
| 6,642,046 | B1 * | 11/2003 | McGarry et al. | 435/287.2 |
| 6,682,926 | B2 * | 1/2004 | Lehmann et al. | 435/287.2 |
| 7,001,572 | B1 * | 2/2006 | Gueritault et al. | 422/68.1 |
| 7,046,357 | B2 * | 5/2006 | Weinberger et al. | 356/246 |
| 7,223,592 | B2 * | 5/2007 | Shea et al. | 435/287.2 |
| 7,364,895 | B2 * | 4/2008 | Besemer et al. | 435/266 |
| 7,585,662 | B2 * | 9/2009 | Weiblen et al. | 435/287.2 |
| 2003/0113724 | A1 * | 6/2003 | Schembri et al. | 435/6 |
| 2003/0235518 | A1 * | 12/2003 | Shea et al. | 422/102 |
| 2004/0001779 | A1 * | 1/2004 | Anderson et al. | 422/99 |
| 2004/0188831 | A1 | 9/2004 | Hsiao | |
| 2004/0214312 | A1 * | 10/2004 | Tyvoll et al. | 435/288.4 |
| 2009/0018034 | A1 * | 1/2009 | Anderson et al. | 506/33 |
| 2009/0036328 | A1 * | 2/2009 | Lee et al. | 506/39 |

FOREIGN PATENT DOCUMENTS

| | | |
|---|---|---|
| JP | 58-166744 | 10/1983 |
| JP | 09-205103 | 8/1997 |
| KR | 10-2002-0037623 | 5/2002 |
| KR | 10-2007-0053545 | 5/2007 |

OTHER PUBLICATIONS

English Abstract for Publication No. 58-166744.
English Abstract for Publication No. 09-205103.
English Abstract for Publication No. 10-2002-0037623.
English Abstract for Publication No. 10-2007-0053545.

* cited by examiner

*Primary Examiner* — Brian J Sines
(74) *Attorney, Agent, or Firm* — F. Chau & Associates, LLC

(57) ABSTRACT

A biochip package body, a method of forming the same, and a biochip package including the biochip package body are provided. The biochip package body includes a mounting package body having a mounting plate. The mounting plate has at least one protruding portion that protrudes therefrom. The protruding portion has a chip mounting portion and a chip protection portion. The chip mounting portion is disposed substantially in the center of the protruding portion. The chip protection portion surrounds the chip mounting portion.

14 Claims, 12 Drawing Sheets

BIOCHIP PACKAGE BODY, METHOD OF FORMING THE SAME, AND BIOCHIP PACKAGE INCLUDING THE BIOCHIP PACKAGE BODY

CROSS-REFERENCE TO RELATED APPLICATIONS

This application claims the benefit under 35 U.S.C. §119 to Korean Patent Application No. 10-2008-0090750, filed on Sep. 16, 2008 with the Korean Intellectual Property Office (KIPO), the contents of which are herein incorporated by reference in their entirety.

BACKGROUND

1. Field

The present disclosure is directed to a biochip package body, a method of forming the same, and a biochip package including the biochip package body.

2. Description of Related Art

In general, a biochip package may include a mounting package body, a covering package body, and a biochip having a desired function between the mounting and covering package bodies. The mounting and covering package bodies may have horizontal planes facing each other. The biochip may be in contact with a test gene sample through the covering package body.

The covering package body may be adhered onto the mounting package body using an adhesive. In this case, the adhesive may be brought into contact with the biochip due to volume shifting of the adhesive flowing out from a gap between the mounting and covering package bodies during application of pressure to the mounting and covering package bodies. Accordingly, the biochip is partially covered with the adhesive and thus cannot sufficiently react with the test gene sample.

SUMMARY

Exemplary embodiments of the invention provide a biochip package body suitable for preventing volume shifting of an adhesive flowing out from a gap between a mounting package body and a covering package body and a biochip package including the biochip package body.

Exemplary embodiments of the invention also provide a method of forming a biochip package body capable of appropriately controlling the flow of an adhesive flowing out from a gap between a mounting package body and a covering package body.

Exemplary embodiments of the present invention provide a biochip package body, a method of forming the biochip package body, and a biochip package including the biochip package body.

According to an exemplary embodiment of the invention, a biochip package body includes a mounting package body. The mounting package body includes at least one protruding portion disposed on a mounting plate and an extending portion extending from the bottom of the at least one protruding portion. The at least one protruding portion includes a chip mounting portion and a chip protection portion. The chip mounting portion is disposed substantially in the center of the at least one protruding portion. The chip protection portion is disposed in a peripheral region of the at least one protruding portion. The chip protection portion surrounds the chip mounting portion.

According to a further exemplary embodiments of the invention, the at least one protruding portion may include a top surface and a lateral surface. The top surface may be disposed at a height from the extending portion. The lateral surface may surround an edge of the top surface. The lateral surface may contact the extending portion. The chip mounting portion may be disposed on the top surface. The chip protection portion may be disposed on the lateral surface.

According to a further exemplary embodiment of the invention, the at least one protruding portion may include at least two steps including lower and upper steps, which are sequentially stacked to have sequentially smaller volumes upward from a main surface of the extending portion. The lower step may be defined by a lower lateral surface and a connection surface. The upper step may be defined by an upper lateral surface and a top surface. The connection surface may connect the lower and upper lateral surfaces. The chip mounting portion may be disposed on the top surface. The chip protection portion may be disposed on the lower lateral surface, the connection surface, and the upper lateral surface.

According to a further exemplary embodiment of the invention, the at least one protruding portion may include a top surface, an outer lateral surface, inner lateral surfaces, and a connection surface. The top surface may be disposed at a height from the extending portion and have an annular opening. The outer lateral surface may surround an outer edge of the top surface. The inner lateral surfaces may define a groove recessed from the annular opening toward the mounting plate. The connection surface may be interposed between the inner lateral surfaces. The connection surface may connect the inner lateral surfaces to each other. The inner lateral surfaces may contact inner edges of the top surface. The chip mounting portion may be disposed on a portion of the top surface surrounded by the annular opening. The chip protection portion may be disposed on the outer lateral surface, the remaining portion of the top surface disposed around the annular opening, the inner lateral surfaces, and the connection surface.

According to a further exemplary embodiment of the invention, the at least one protruding portion may include a top surface, an outer lateral surface, an inner lateral surface, and a bottom surface. The top surface may be disposed at a height from the extending portion and have a hole. The outer lateral surface may surround an outer edge of the top surface. The inner lateral surface and the bottom surface may be recessed from the hole toward the mounting plate. The inner lateral surface may contact an inner edge of the top surface. The chip mounting portion may be disposed on the bottom surface. The chip protection portion may be disposed on the outer lateral surface, the top surface, and the inner lateral surface.

According to further exemplary embodiments of the invention, the at least one protruding portion may include a top surface, an outer lateral surface, and an upper inner lateral surface, a connection surface, a lower inner lateral surface and a bottom surface to have at least two grooves including upper and lower grooves. The top surface may be disposed at a height from the extending portion and have a hole. The outer lateral surface may surround an outer edge of the top surface. The upper and lower grooves may be recessed from the hole toward the mounting plate and have sequentially smaller apertures.

The upper inner lateral surface and the connection surface may define the upper groove, and the lower inner lateral surface and the bottom surface may define the lower groove. The upper inner lateral surface may surround an inner edge of the top surface. The connection surface may connect the upper and lower inner lateral surfaces. The chip mounting portion may be disposed on the bottom surface. The chip protection portion may be disposed on the outer lateral surface, the top surface, the upper and lower inner lateral surfaces, and the connection surface.

According to further exemplary embodiments of the invention, the biochip package body may further include a covering package body. The covering package body may be disposed on the mounting package body. The covering package body may include a landing window and a peripheral portion. The landing window may be disposed in a covering plate and may be positioned to expose the at least one protruding portion. The peripheral portion may surround the landing window and may correspond to the extending portion of the mounting package body.

According to another exemplary embodiment of the invention, a biochip package includes a mounting package body, a covering package body, and a biochip. The mounting package body includes at least one protruding portion disposed on a mounting plate and an extending portion extending from the bottom of the at least one protruding portion. The at least one protruding portion includes a chip mounting portion and a chip protection portion. The chip mounting portion is disposed substantially in the center of the at least one protruding portion. The chip protection portion is disposed in a peripheral region of the at least one protruding portion. The chip protection portion surrounds the chip mounting portion. The covering package body is disposed on the mounting package body. The covering package body includes a landing window and a peripheral portion. The landing window is disposed in a covering plate and exposes the at least one protruding portion, and the peripheral portion surrounds the landing window. The biochip is disposed on the chip mounting portion of the at least one protruding portion and exposed through the landing window.

According to a further exemplary embodiment of the invention, the at least one protruding portion may include a top surface and a lateral surface. The top surface may be disposed at a height from the extending portion. The lateral surface may surround an edge of the top surface. The lateral surface may contact the extending portion. The chip mounting portion may be disposed on the top surface. The chip protection portion may be disposed on the lateral surface.

According to a further exemplary embodiment of the invention, the at least one protruding portion may include at least two steps including lower and upper steps, which are sequentially stacked to have sequentially smaller volumes upward from a main surface of the extending portion. The lower step may be defined by a lower lateral surface and a connection surface. The upper step may be defined by an upper lateral surface and a top surface. The connection surface may connect the lower and upper lateral surfaces. The chip mounting portion may be disposed on the top surface. The chip protection portion may be disposed on the lower lateral surface, the connection surface, and the upper lateral surface.

According to a further exemplary embodiment of the invention, the at least one protruding portion may include a top surface, an outer lateral surface, inner lateral surfaces, and a connection surface. The top surface may be disposed at a height from the extending portion and have an annular opening. The outer lateral surface may surround an outer edge of the top surface. The inner lateral surfaces and a connection surface may define a groove recessed from the annular opening toward the mounting plate. The connection surface may be interposed between the inner lateral surfaces. The connection surface may connect the inner lateral surfaces to each other. The inner lateral surfaces may contact inner edges of the top surface. The chip mounting portion may be disposed on a portion of the top surface surrounded by the annular opening. The chip protection portion may be disposed on the outer lateral surface, the remaining portion of the top surface disposed around the annular opening, the inner lateral surfaces, and the connection surface.

According to a further exemplary embodiment of the invention, the at least one protruding portion may include a top surface, an outer lateral surface, an inner lateral surface, and a bottom surface. The top surface may be disposed at a height from the extending portion and have a hole. The outer lateral surface may surround an outer edge of the top surface. The inner lateral surface and the bottom surface may be recessed from the hole toward the mounting plate. The inner lateral surface may contact an inner edge of the top surface. The chip mounting portion may be disposed on the bottom surface. The chip protection portion may be disposed on the outer lateral surface, the top surface, and the inner lateral surface.

According to further exemplary embodiments of the invention, the at least one protruding portion may include a top surface, an outer lateral surface, and an upper inner lateral surface, a connection surface, a lower inner lateral surface and a bottom surface to have at least two grooves including upper and lower grooves. The top surface may be disposed at a height from the extending portion and have a hole. The outer lateral surface may surround an outer edge of the top surface. The upper and lower grooves may be recessed from the hole toward the mounting plate and have sequentially smaller apertures.

The upper inner lateral surface and the connection surface may define the upper groove, and the lower inner lateral surface and the bottom surface may define the lower groove. The upper inner lateral surface may surround an inner edge of the top surface. The connection surface may connect the upper and lower inner lateral surfaces. The chip mounting portion may be disposed on the bottom surface. The chip protection portion may be disposed on the outer lateral surface, the top surface, the upper and lower inner lateral surfaces, and the connection surface.

According to further exemplary embodiments of the invention, the biochip may include one selected from a deoxyribonucleic acid (DNA) chip and a protein chip.

According to another exemplary embodiment of the invention, a method of forming a biochip package body includes: preparing a base plate; and etching the base plate to form a mounting package body having a mounting plate. The mounting plate includes at least one protruding portion protruding from the mounting plate, and an extending portion that extends from the bottom of the at least one protruding portion.

According to a further exemplary embodiment of the invention, the formation of the mounting package body may include: forming at least one mask pattern on the base plate; partially etching the base plate using the at least one mask pattern as a mask; and removing the at least one mask pattern from the mounting plate.

According to a further exemplary embodiment of the invention, the formation of the mounting package body may include: forming at least one first mask pattern on the base plate; partially etching the base plate using the at least one first mask pattern as a mask; and removing the at least one first mask pattern from the base plate. Also, the formation of the mounting package body may further include: forming a second mask pattern occupying a larger area than the at least one first mask pattern on the base plate; partially etching the base plate using the second mask pattern as a mask; and removing the second mask pattern from the mounting plate. The second mask pattern may have substantially the same center as the at least one first mask pattern.

According to a further exemplary embodiment of the invention, the formation of the mounting package body may include: forming at least one mask pattern on the base plate; partially etching the base plate using the at least one mask pattern as a mask; removing the at least one mask pattern from the base plate; and forming a mask layer on the base plate. In this case, the mask layer may have an annular opening exposing the base plate. The opening may be formed in a region occupied by the at least one mask pattern. The formation of the mounting package body may further include: partially etching the base plate using the mask layer as a mask; and removing the mask layer from the mounting plate.

According to a further exemplary embodiment of the invention, the formation of the mounting package body may include: forming at least one mask pattern on the base plate; partially etching the base plate using the at least one mask pattern as a mask; removing the at least one mask pattern from the base plate; and forming a mask layer on the base plate. In this case, the mask layer may have an opening exposing the base plate. The opening may be formed in a region occupied by the at least one mask pattern. Also, the formation of the mounting package body may further include: partially etching the base plate using the mask layer as a mask; and removing the mask layer from the mounting plate.

According to further exemplary embodiments of the invention, the formation of the mounting package body may include: forming a first mask layer on the base plate, the first mask layer having at least one first opening exposing the base plate; partially etching the base plate using the first mask layer as a mask; removing the first mask layer from the base plate; and forming a second mask layer on the base plate. In this case, the second mask layer may have a second opening that exposes the base plate and has substantially the same center as the at least one first opening. The second opening may occupy a smaller area than the at least one first opening. Also, the formation of the mounting package body may further include: partially etching the base plate using the second mask layer as a mask; and removing the second mask layer from the mounting plate.

According to further exemplary embodiments of the invention, the method may further include forming a covering package body having a covering plate on the mounting package body. The covering plate may include a landing window and a peripheral portion. The landing window may be positioned to expose the protruding portion of the mounting plate, and the peripheral portion may surround the landing window and may correspond to the extending portion of the mounting plate.

BRIEF DESCRIPTION OF THE DRAWINGS

Exemplary embodiments are described in further detail below with reference to the accompanying drawings. It should be understood that various aspects of the drawings may have been exaggerated for clarity.

DETAILED DESCRIPTION OF EXEMPLARY EMBODIMENTS

Various exemplary embodiments will now be described more fully with reference to the accompanying drawings in which some exemplary embodiments are shown. Embodiments of the present invention may, however, be embodied in different forms and should not be construed as limited to those set forth herein.

Hereinafter, a biochip package body according to exemplary embodiments of the invention will be described in detail with reference to FIG. 1.

Figure 1:
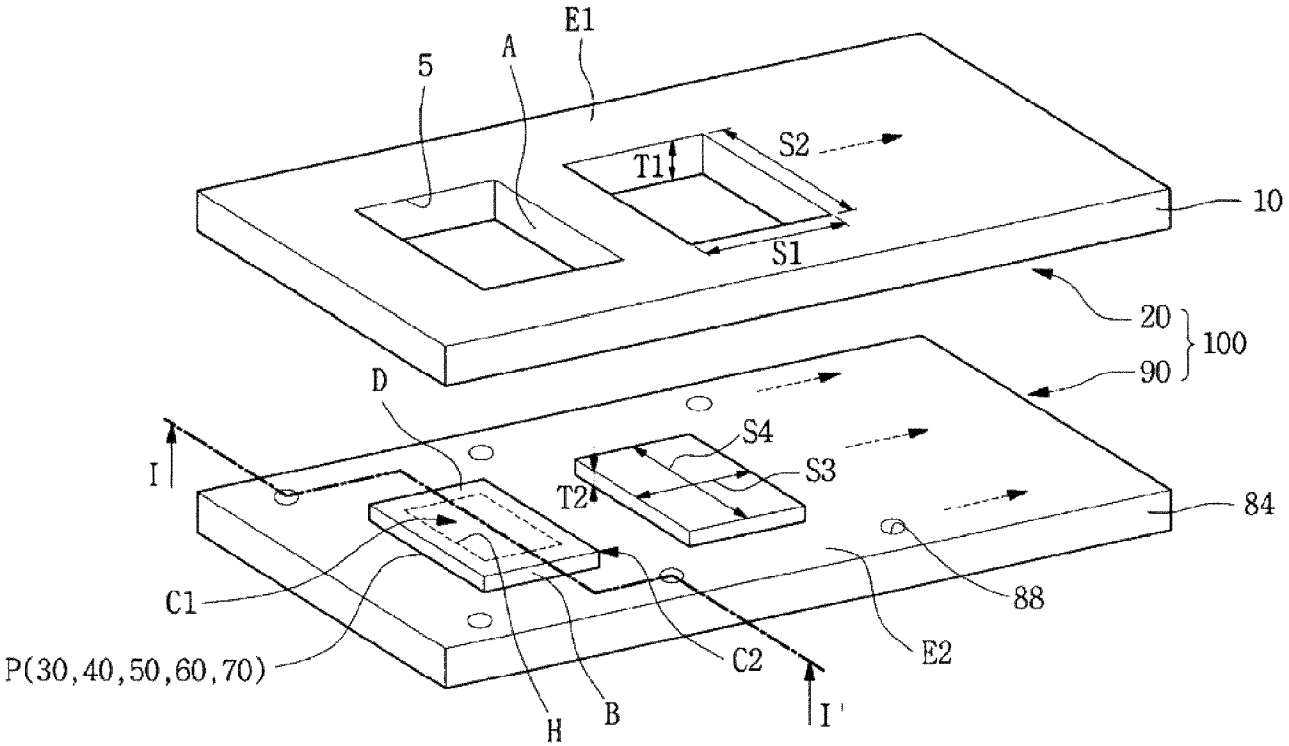
FIG. 1 is a schematic view of a biochip package body according to exemplary embodiments of the invention.

FIG. 1 is a schematic view of a biochip package body according to exemplary embodiments of the invention.

Referring to FIG. 1, a biochip package body 100 may include a covering package body 20, which may have a covering plate 10. The covering plate 10 may have one or more landing windows 5 and a peripheral portion E1 that defines the landing window 5. The covering plate 10 may have a thickness T1. In the non-limiting example depicted in FIG. 1, two landing windows 5 are shown. For the sake of clarity, different components or properties are indicated on different landing windows.

When the landing window 5 has a quadrilateral shape in a plan view, it may have a width S1 and a length S2. The landing window 5 may have a plane figure other than a quadrilateral in the plan view. The landing window 5 may have a guide surface A penetrating the covering plate 10. The depth of the guide surface A of the landing window 5 may be equal to the thickness T1 of the covering plate 10.

The biochip package body 100 may further include a mounting package body 90. The mounting package body 90 may be disposed under the covering package body 20. The mounting package body 90 may have a mounting plate 84. The mounting plate 84 may have at least one protruding portion P and an extending portion E2. The number of protruding portions P may equal to the number of landing windows 5. The protruding portion P may be integrally formed with the mounting plate 84 and protrude from the mounting plate 84.

According to exemplary embodiments of the invention, the protruding portion P may be disposed on the mounting plate 84 and protrude from the mounting plate 84. The protruding portion P may have a top surface D and a lateral surface B. When the top surface D has a quadrilateral shape, it may have a width S3 and a length S4. The width and length S3 and S4 of the top surface D may be respectively smaller than the width and length S1 and S2 of the landing window 5.

According to exemplary embodiments of the invention, the lateral surface B of the protruding portion P may surround an outer edge of the top surface D. The protruding portion P may be exposed through the landing window 5 of the covering package body 20. A thickness T2 of the protruding portion P may be the same as or different from the thickness T1 of the covering plate 10. The protruding portion P may have a chip mounting portion C1 and a chip protection portion C2. The chip mounting portion C1 may be disposed substantially in the center of the protruding portion P.

According to exemplary embodiments of the invention, the chip protection portion C2 may be disposed in a peripheral region of the protruding portion P, which surrounds the chip mounting portion C1. The protruding portion P may have at least one hole H formed in the top surface D and at least one groove (not shown) formed downward from the top surface D having the hole H. The extending portion E2 may contact the protruding portion P and extend from the bottom of the protruding portion P. The extending portion E2 may correspond to the peripheral portion E1.

According to exemplary embodiments of the invention, the extending portion E2 may have at least one damp pattern 88 formed adjacent to the protruding portion P. The damp pattern 88 may be a hole or a belt-shaped groove other than the hole. Together with the protruding portion P, the damp pattern 88 may function to prevent volume shifting of an adhesive (not shown) due to pressure applied between the covering and mounting package bodies 20 and 90.

Hereinafter, methods of forming a biochip package body according to respective exemplary embodiments of the invention will be sequentially described with reference to FIGS. 2 through 23. In this case, the same reference numerals are used to denote the same materials and elements throughout the exemplary embodiments of the invention.

Figure 2:
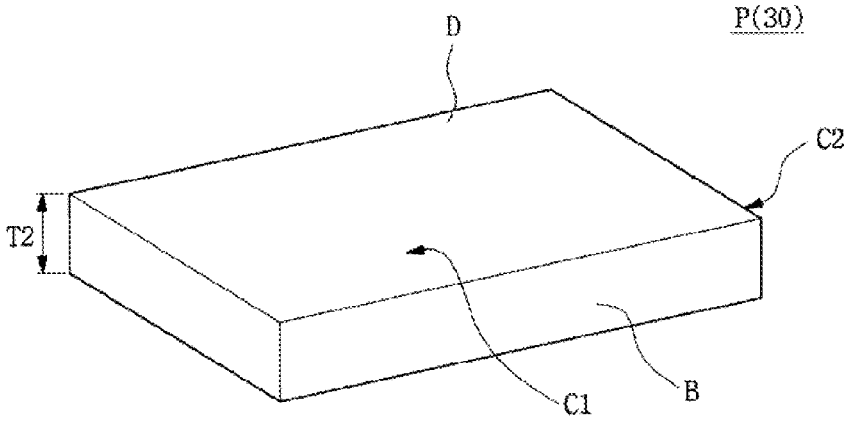
FIG. 2 is a schematic view of a protruding portion of FIG. 1, according to an exemplary embodiment of the invention.
Figure 7:
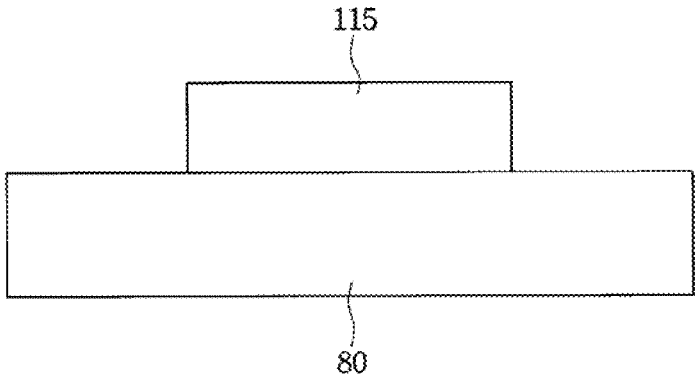
FIGS. 7 through 9 are cross-sectional views illustrating a method of forming the biochip package body of FIG. 1, according to an exemplary embodiment of the invention.
Figure 8:
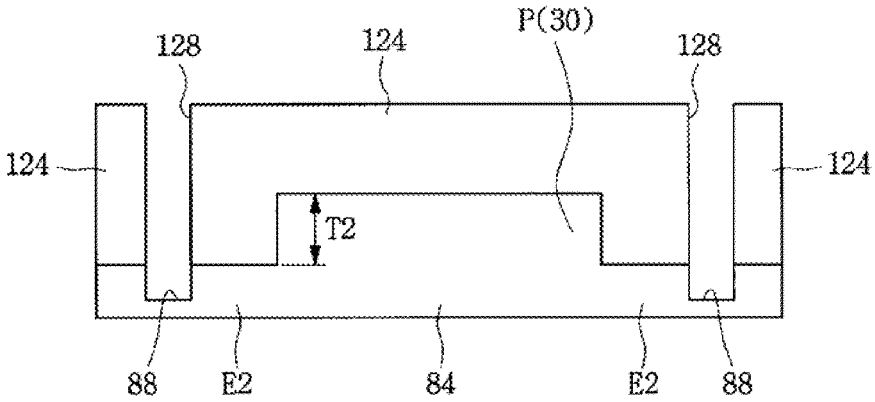
Figure 9:
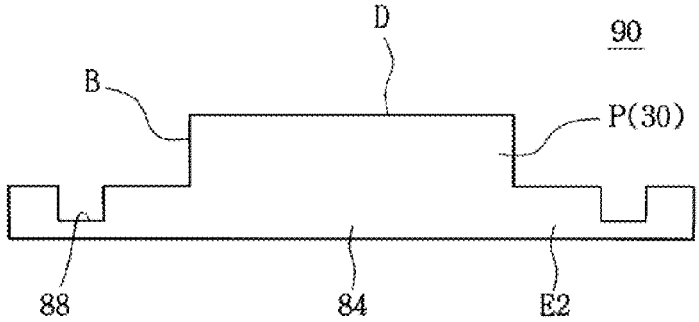

FIG. 2 is a schematic view of a protruding portion of FIG. 1, according to an exemplary embodiment of the invention, and FIGS. 7 through 9 are cross-sectional views illustrating a method of forming the biochip package body of FIG. 1, according to an exemplary embodiment of the invention.

Referring to FIGS. 2 and 7, a base chip 80 may be prepared as shown in FIG. 7. The base plate 80 may be formed of glass, plastic, or a flexible material. At least one mask pattern 115 may be formed on the base plate 80 as shown in FIG. 7. The mask pattern 115 may correspond to the protruding portion (refer to P of FIG. 1 or 30 of FIG. 2). The mask pattern 115 may be formed of photoresist, an insulating material, or a stacked layer thereof.

Referring to FIGS. 2 and 8, the base plate 80 may be etched to a thickness T2 using the mask pattern 115 as a mask as shown in FIG. 8. As a result, a mounting plate 84 may be formed under the mask pattern 115. The mounting plate 84 may have the protruding portion P(30) as shown in FIG. 8.

The mounting portion 84 may have an extending portion E2, which contacts the protruding portion P(30) and extends from the bottom of the protruding portion P(30).

According to an exemplary embodiment of the invention, after the extending portion E2 is formed, the mask pattern 115 may be removed from the mounting plate 84. Subsequently, a mask layer 124 may be formed on the mounting plate 84 as shown in FIG. 8. The mask layer 124 may have at least one opening 128 exposing the extending portion E2 of the mounting plate 84. The mounting plate 84 may be partially etched using the mask layer 124 as a mask, thereby forming at least one damp pattern 88.

Referring to FIGS. 1, 2 and 9, after the damp pattern 88 is formed, the mask layer 124 may be removed from the mounting plate 84. As a result, the mounting plate 84 may have the protruding portion P(30) and the damp pattern 88 as shown in FIG. 9. According to a variation of an exemplary embodiment of the invention, the mounting plate 84 may have only the protruding portion P(30). More specifically, the protruding portion P(30) may have a chip mounting portion C1 and a chip protection portion C2 as shown in FIG. 1.

According to an exemplary embodiment of the invention, the chip mounting portion C1 may be disposed on a top surface D of the protruding portion P(30). The top surface D may be disposed at a height T2 from the extending portion E2. In this case, the chip mounting portion C1 may be disposed substantially in the center of the top surface D of the protruding portion P(30). The chip protection portion C2 may be disposed on a lateral surface B of the protruding portion P(30). The lateral surface B may surround an outer edge of the top surface D and contact the extending portion E2. Thus, the chip protection portion C2 may be disposed in a peripheral region of the protruding portion P(30).

According to an exemplary embodiment of the invention, the protruding portion P(30) and the damp pattern 88 may be formed in the mounting plate 84 and comprise the mounting package body 90 of FIG. 1. According to a variation of an exemplary embodiment of the invention, the mounting package body 90 may have only the protruding portion P(30). According to another variation of an exemplary embodiment of the invention, the protruding portion P(30) of FIG. 2 may be separately formed and adhered onto the base plate 80. In this case, the base plate 80 may take the place of the mounting plate 84 of FIG. 1. Also, when pressure is applied to the covering and mounting package bodies 20 and 90 of FIG. 1, the chip protection portion C2 and/or the damp pattern 88 may appropriately control the flow of an adhesive (not shown) flowing out from a gap between the covering and mounting package bodies 20 and 90.

Figure 3:
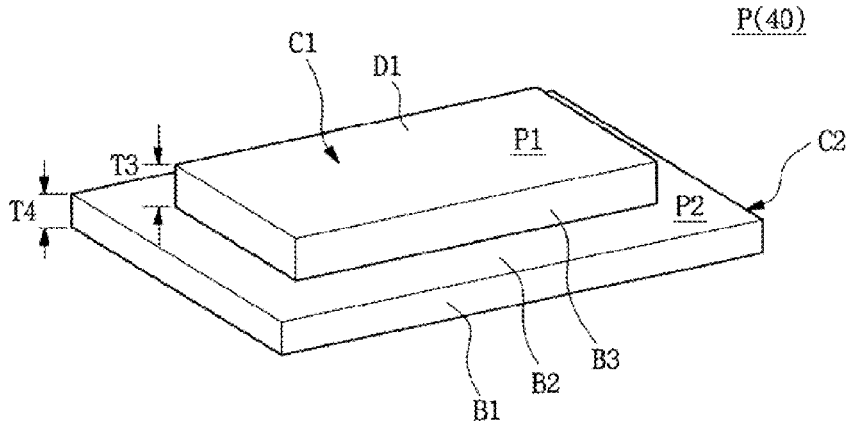
FIG. 3 is a schematic view of the protruding portion of FIG. 1, according to another exemplary embodiment of the invention.

FIG. 3 is a schematic view of a protruding portion of FIG. 1, according to another exemplary embodiment of the invention, and FIGS. 10 through 13 are cross-sectional views illustrating a method of forming the biochip package body of FIG. 1, according to another exemplary embodiment of the invention.

Figure 10:
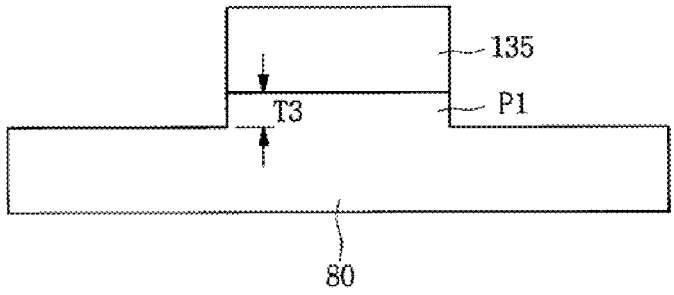
FIGS. 10 through 13 are cross-sectional views illustrating a method of forming the biochip package body of FIG. 1, according to another exemplary embodiment of the invention.

Referring to FIGS. 3 and 10, at least one first mask pattern 135 may be formed on a base plate 80 as shown in FIG. 10. The first mask pattern 135 may occupy the same area as or a different area from the mask pattern 115 of FIG. 7 on the base plate 80. The base plate 80 may be etched to a thickness T3 using the first mask pattern 135 as a mask as shown in FIG. 10. As a result, a first protruding portion P1 corresponding to the first mask pattern 135 may be formed under the first mask pattern 135. The first protruding portion P1 may correspond to an upper step of FIG. 3.

Figure 11:
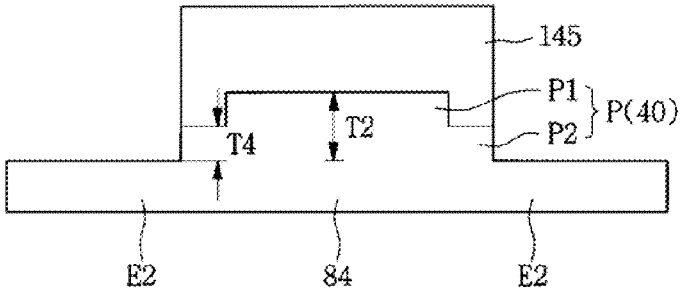

Referring to FIGS. 3 and 11, after the first protruding portion P1 is formed, the first mask pattern 135 may be removed from the base plate 80. Subsequently, at least one second mask pattern 145 may be formed on the base plate 80 to cover the first protruding portion P1 as shown in FIG. 11.

The second mask pattern 145 may be provided in equal number to the first mask pattern 135. The second mask pattern 145 may have substantially the same center as the first mask pattern 135.

According to this exemplary embodiment of the invention, the base plate 80 may be etched to a thickness T4 using the second mask 145 as a mask as shown in FIG. 11. As a result, a mounting plate 84 may be formed under the second mask pattern 145. The mounting plate 84 may have not only the first protruding portion P1 but also a second protruding portion P2. The second protruding portion P2 may correspond to the second mask pattern 145, and may correspond to a lower step of FIG. 3.

According to this exemplary embodiment of the invention, the sum T3+T4 of the first and second protruding portions P1 and P2 may be the same as or different from the thickness T2 of the protruding portion P of FIG. 2. Also, the mounting plate 84 may have an extending portion E2, which contacts the second protruding portion P2 and extends from the bottom of the second protruding portion P2, as shown in FIG. 11.

Figure 12:
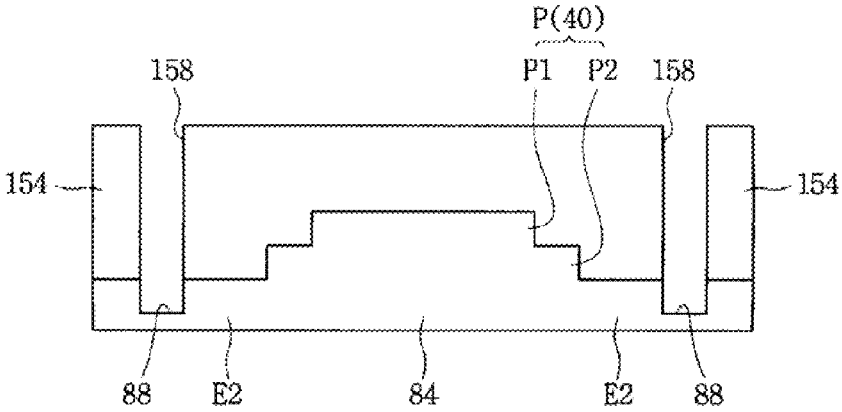

Referring to FIGS. 3 and 12, after the second protruding portion P2 is formed, the second mask pattern 145 may be removed from the mounting plate 84. Thereafter, a mask layer 154 may be formed on the mounting plate 84 as shown in FIG. 12. The mask layer 154 may have at least one opening 158 exposing the extending portion E2 of the mounting plate 84. The mounting plate 84 may be partially etched using the mask layer 154 as a mask, thereby forming at least one damp pattern 88 as shown in FIG. 12.

Figure 13:
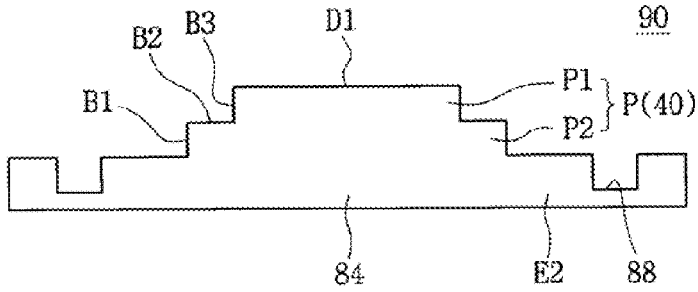

Referring to FIGS. 3 and 13, after the damp pattern 88 is formed, the mask layer 154 may be removed from the mounting plate 84. In this case, the first and second protruding portions P1 and P2 may comprise a protruding portion P(40) of FIG. 3 as shown in FIG. 13. As a result, the mounting plate 84 may have the protruding portion P(40) and the damp pattern 88 as shown in FIG. 13. According to a variation of this embodiment, the mounting plate 84 may have only the protruding portion P(40).

More specifically, the volume of the protruding portion P(40) decreases upward from a main surface of the extending portion E2 so that the protruding portion P(40) may have the upper and lower steps P1 and P2 that are stacked sequentially as shown in FIG. 3. The upper step P1 may be defined by an upper lateral surface B3 and a top surface D1 on the lower step P2. The lower step P2 may be defined by a lower lateral surface B1 and a connection surface B2. The connection surface B2 may connect the lower and upper lateral surfaces B1 and B3. According to a variation of this embodiment, the protruding portion P(40) may have three or more steps.

According to this exemplary embodiment of the invention, the protruding portion P(40) may have a chip mounting portion C1 and a chip protection portion C2 provided by the upper and lower steps P1 and P2 as shown in FIG. 3. The chip mounting portion C1 may be disposed on the top surface D1 of the protruding portion P(40). In this case, the chip mounting portion C1 may be disposed substantially in the center of the top surface D1. Also, the chip protection portion C2 may be disposed on the lower lateral surface B1, the connection surface B2, and the upper lateral surface B3. Accordingly, the chip protection portion C2 may be disposed in a peripheral region of the protruding portion P(40).

According to this exemplary embodiment of the invention, the protruding portion P(40) and the damp pattern 88 may be formed in the mounting plate 84 and comprise the mounting package body 90 of FIG. 1. According to a variation of this embodiment, the mounting package body 90 may only have the protruding portion P(40). According to another variation of this embodiment, the protruding portion P(40) of FIG. 3 may be separately formed and adhered onto the base plate 80. In this case, the base plate 80 may take the place of the mounting plate 84 of FIG. 1. Also, when pressure is applied to the covering and mounting package bodies 20 and 90 of FIG. 1, the chip protection portion C2 and/or the damp pattern 88 may appropriately control the flow of an adhesive (not shown) flowing out from a gap between the covering and mounting package bodies 20 and 90.

Figure 4:
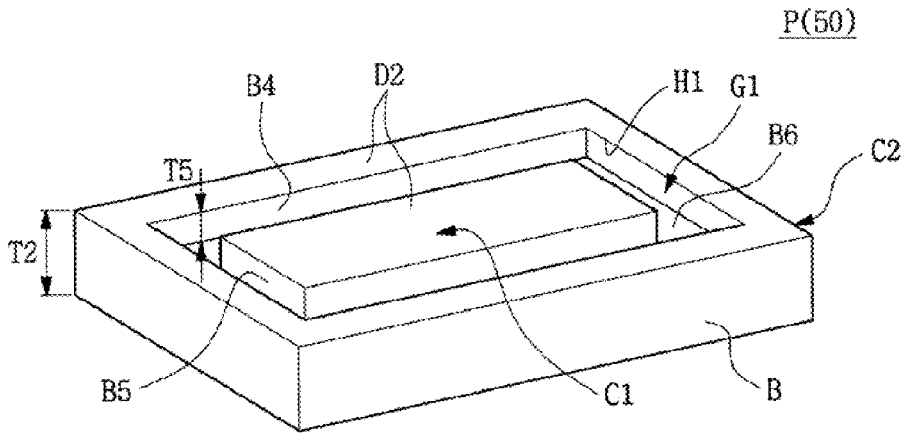
FIG. 4 is a schematic view of the protruding portion of FIG. 1, according to another exemplary embodiment of the invention.
Figure 14:
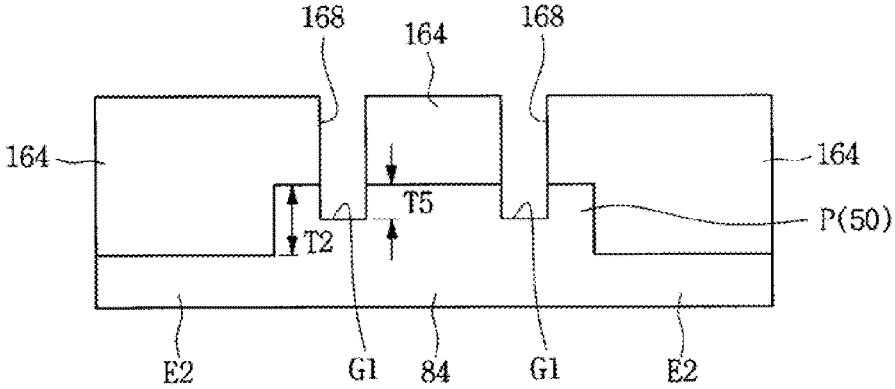
FIGS. 14 through 16 are cross-sectional views illustrating a method of forming the biochip package body of FIG. 1, according to another exemplary embodiment of the invention.
Figure 15:
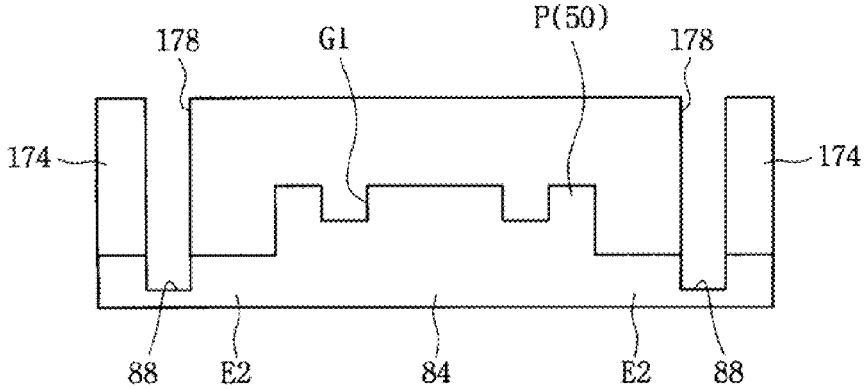
Figure 16:
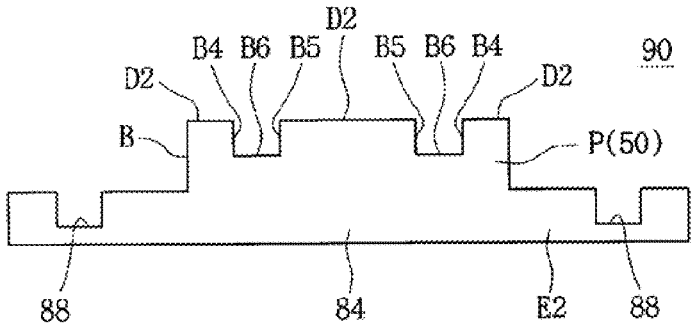

FIG. 4 is a schematic view of a protruding portion of FIG. 1, according to another exemplary embodiment of the invention, and FIGS. 14 through 16 are cross-sectional views illustrating a method of forming the biochip package body of FIG. 1, according to this exemplary embodiment.

Referring to FIGS. 4 and 14, the processes performed up until forming the protruding portion P(30) of FIG. 8 are the same as the processes of the embodiment of FIGS. 2 and 7-9, and thus, the description will begin with the subsequent processes. According to this embodiment, a first mask layer 164 may be formed on a base plate 80 having the protruding portion P(30) as shown in FIG. 14. The first mask layer 164 may have an annular opening 168 exposing the protruding portion P(30). The opening 168 may be disposed in a region occupied by the mask pattern 115, shown in FIG. 7. The opening 168 may have substantially the same center as the mask pattern 115.

According to this embodiment, the mask pattern 115 and the first mask layer 164 may correspond to a protruding portion P(50) of FIG. 4. The base plate 80 may be etched by a thickness T5 using the first mask layer 164 as a mask as shown in FIG. 14. As a result, a mounting plate 84 may be formed under the first mask layer 164. The mounting plate 84 may have a groove G1 along the opening 168 of the first mask layer 164. The mounting plate 84 may have the protruding portion P(50) of FIG. 4 as shown in FIG. 14.

According to this embodiment, the thickness T2 of the protruding portion P(50) may be the same as or different from the depth T5 of the groove G1.

The mounting plate 84 may have an extending portion E2, which contacts the protruding portion P(50) and extends from the bottom of the protruding portion P(50), as shown in FIG. 14.

Referring to FIGS. 4 and 15, after the protruding portion P(50) is formed, the first mask layer 164 may be removed from the mounting plate 84. Thereafter, a second mask layer 174 may be formed on the mounting plate 84 as shown in FIG. 15. The second mask layer 174 may have at least one opening 178 exposing the extending portion E2 of the mounting plate 84. The mounting plate 84 may be partially etched using the second mask layer 174 as a mask, thereby forming at least one damp pattern 88 as shown in FIG. 15.

Referring to FIGS. 4 and 16, after the damp pattern 88 is formed, the second mask layer 174 may be removed from the mounting plate 84. In this case, the mounting plate 84 may have the protruding portion P(50) and the damp pattern 88 as shown in FIG. 16. According to a variation of this embodiment, the mounting plate 84 may have only the protruding portion P(50). More specifically, the protruding portion P(50) may have a top surface D2, an outer lateral surface B, inner lateral surfaces B4 and B5, and a connection surface B6 interposed between the inner lateral surfaces B4 and B5 as shown in FIG. 4.

According to this embodiment, the top surface D2 may have an annular opening H1, which is formed to a height T2 from the extending portion E2, as shown in FIG. 4. The outer lateral surface B may surround an outer edge of the top surface D2 as shown in FIG. 4. Also, the inner lateral surfaces B4 and B5 and the connection surface B6 may define the groove G1, which is recessed downward from the top surface D2 having the hole H1, as shown in FIG. 4. The inner lateral surfaces B4 and B5 may respectively contact inner edges of the top surface D2. The connection surface B6 may connect the inner lateral surfaces B4 and B5.

According to this embodiment, the protruding portion P(50) may have a chip mounting portion C1 and a chip protection portion C2 defined by the top surface D2, the outer lateral surface B, the inner lateral surfaces B4 and B5, and the connection surface B6 as shown in FIG. 4. The chip mounting portion C1 may be disposed on a portion of the top surface D2 surrounded by the hole H1. The chip mounting portion C1 may be disposed substantially in the center of the top surface D2. The chip protection portion C2 may be disposed on the outer lateral surface B, the remaining portion of the top surface D2 around the hole H1, the inner lateral surfaces B4 and B5, and the connection surface B6. Accordingly, the chip protection portion C2 may be disposed in a peripheral region of the protruding portion P(50).

According to this embodiment, the protruding portion P(50) and the damp pattern 88 may be formed in the mounting plate 84 and comprise the mounting package body 90 of FIG. 1. According to a variation of this embodiment, the mounting package body 90 may have only the protruding portion P(50). According to another variation of this embodiment, the protruding portion P(50) of FIG. 4 may be separately formed and adhered onto the base plate 84. In this case, the base plate 80 may take the place of the mounting plate 84 of FIG. 1. Also, when pressure is applied to the covering and mounting packages of FIG. 1, the chip protection portion C2 and/or the damp pattern 88 may appropriately control the flow of an adhesive (not shown) flowing out from a gap between the covering and mounting package bodies 20 and 90.

Figure 5:
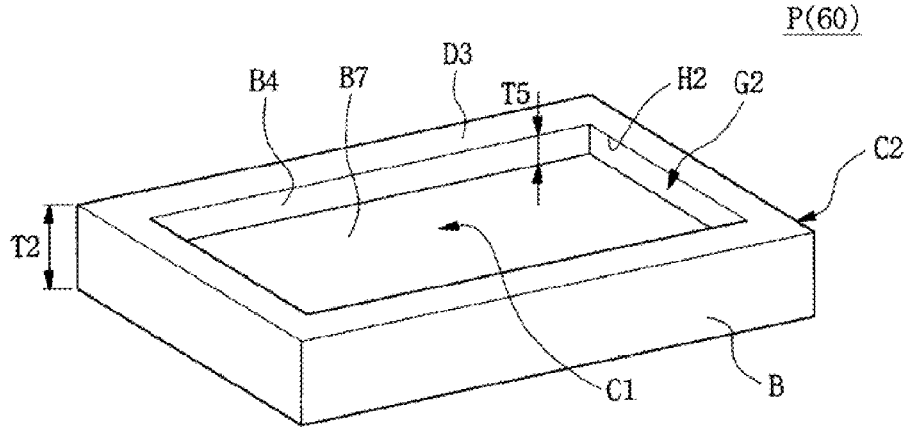
FIG. 5 is a schematic view of the protruding portion of FIG. 1, according to another exemplary embodiment of the invention.
Figure 17:
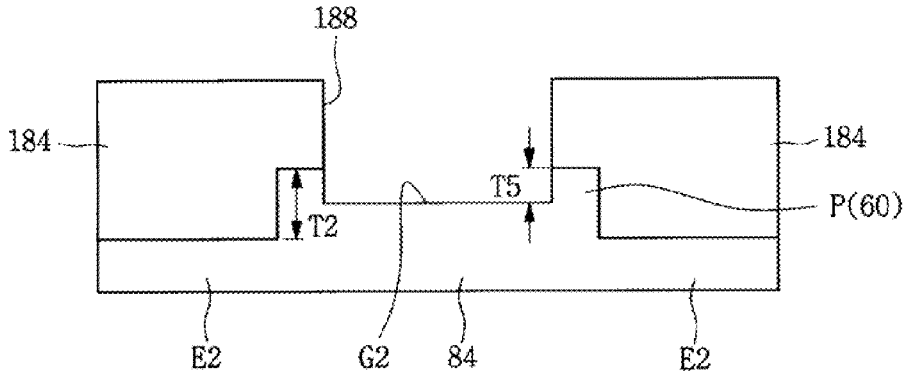
FIGS. 17 through 19 are cross-sectional views illustrating a method of forming the biochip package body of FIG. 1, according to another exemplary embodiment of the invention.
Figure 18:
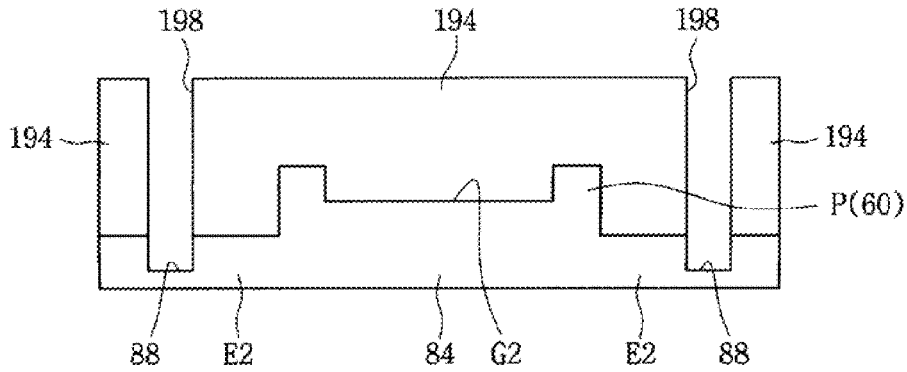
Figure 19:
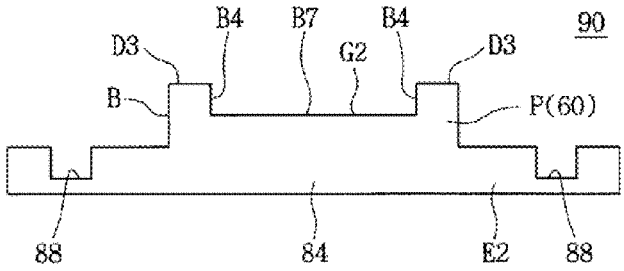

FIG. 5 is a schematic view of a protruding portion of FIG. 1, according to another exemplary embodiment of the invention, and FIGS. 17 through 19 are cross-sectional views illustrating a method of forming the biochip package body of FIG. 1, according to another exemplary embodiment of the invention.

Referring to FIGS. 5 and 17, the processes performed up until forming the protruding portion P(30) of FIG. 8 are the same as the processes of the embodiment of FIGS. 2 and 7-9, and thus, the description will begin with the subsequent processes. According to this embodiment, a first mask layer 184 may be formed on a base plate 80 having the protruding portion P(30) as shown in FIG. 17. The first mask layer 184 may have an opening 188 exposing the protruding portion P(30). The opening 188 may be formed in a region occupied by the mask pattern 115, shown in FIG. 7. The opening 188 may have substantially the same center as the mask pattern 115.

According to this embodiment, the mask pattern 115 and the first mask layer 184 may correspond to a protruding portion P(60) of FIG. 5. The base plate 80 may be etched to a thickness T5 using the first mask layer 184 as a mask as shown in FIG. 17. As a result, a mounting plate 84 may be formed under the first mask layer 184. The mounting plate 84 may have a groove G2 corresponding to the opening 188 of the first mask layer 184. The mounting plate 84 may have the protruding portion P(60) of FIG. 5 as shown in FIG. 17.

According to this embodiment, the thickness T2 of the protruding portion P(60) may be the same as or different from the depth T5 of the groove G2. The mounting plate 84 may have an extending portion E2, which contacts the protruding portion P(60) and extends from the bottom of the protruding portion P(60), as shown in FIG. 17.

Referring to FIGS. 5 and 18, after the protruding portion P(60) is formed, the first mask layer 184 may be removed from the mounting plate 84. Thereafter, a second mask layer 194 may be formed on the mounting plate 84 as shown in FIG. 18. The second mask layer 194 may have at least one opening 198 exposing the extending portion E2 of the mounting plate 84. The mounting plate 84 may be partially etched using the second mask layer 194 as a mask, thereby forming at least one damp pattern 88 as shown in FIG. 18.

Referring to FIGS. 5 and 19, after the damp pattern 88 is formed, the second mask layer 194 may be removed from the mounting plate 84. In this case, the mounting plate 84 may have the protruding portion P(60) and the damp pattern 88 as shown in FIG. 19. According to a variation of this embodiment, the mounting plate 84 may have only the protruding portion P(60). More specifically, the protruding portion P(60) may have a top surface D3, an outer lateral surface B, an inner lateral surface B4, and a bottom surface B7 as shown in FIG. 5.

According to this embodiment, the top surface D3 may be disposed at a height T2 from the extending portion E2 and have a hole H2 as shown in FIG. 5. The outer lateral surface B may surround an outer edge of the top surface D3 as shown in FIG. 5. The inner lateral surface B4 and the bottom surface B7 may define the groove G2, which is recessed downward from the top surface D3 having the hole H2, as shown in FIG. 5. The inner lateral surface B4 may contact an inner edge of the top surface D3.

According to this embodiment, the protruding portion P(60) may have a chip mounting portion C1 and a chip protection portion C2 defined by the top surface D3, the outer lateral surface B, the inner lateral surface B4, and the bottom surface B7 as shown in FIG. 5. The chip mounting portion C1 may be disposed on the bottom surface B7 of the protruding portion P(60). The chip mounting portion C1 may be disposed substantially in the center of the bottom surface B7. The chip protection portion C2 may be disposed on the outer lateral surface B, the top surface D3, and the inner lateral surface B4. Accordingly, the chip mounting portion C1 may be disposed in a peripheral region of the protruding portion P(60).

According to this embodiment, the protruding portion P(60) and the damp pattern 88 may be formed in the mounting plate 84 and comprise the mounting package body 90 of FIG. 1. According to a variation of this embodiment, the mounting package body 90 may have only the protruding portion P(60). According to another variation of this embodiment, the protruding portion P(60) of FIG. 5 may be separately formed and adhered onto the base plate 80. In this case, the base plate 80 may take the place of the mounting plate 84 of FIG. 1. Also, when pressure is applied to the covering and mounting package bodies 20 and 90 of FIG. 1, the chip protection portion C2 and/or the damp pattern 88 may appropriately control the flow of an adhesive (not shown) flowing out from a gap between the covering and mounting package bodies 20 and 90.

Figure 6:
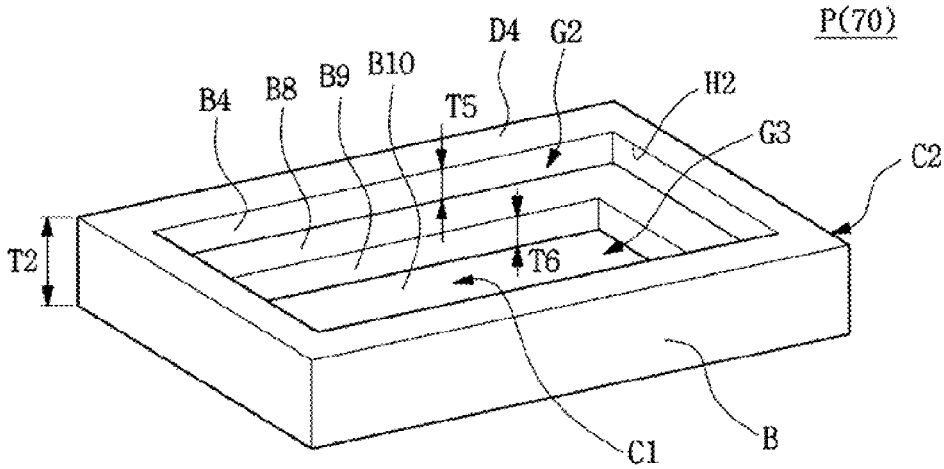
FIG. 6 is a schematic view of the protruding portion of FIG. 1, according to another exemplary embodiment of the invention.

FIG. 6 is a schematic view of a protruding portion of FIG. 1, according to another exemplary embodiment of the invention, and FIGS. 20 through 23 are cross-sectional views illustrating a method of forming the biochip package body of FIG. 1, according to another exemplary embodiment of the invention.

Figure 20:
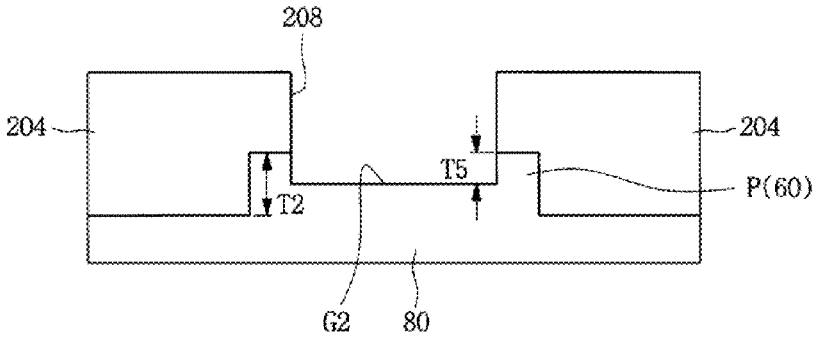
FIGS. 20 through 23 are cross-sectional views illustrating a method of forming the biochip package body of FIG. 1, according to another exemplary embodiment of the invention.

Referring to FIGS. 6 and 20, the processes performed up until forming the protruding portion P(30) of FIG. 8 are the same as the processes of the embodiment of FIGS. 2 and 7-9, and thus, the description will begin with the subsequent processes. According to this embodiment, a first mask layer 204 may be formed on a base plate 80 having the protruding portion P(30) as shown in FIG. 20. The first mask layer 204 may have an opening 208 exposing the protruding portion P(30). The opening 208 may be formed in a region occupied by the mask pattern 115, shown in FIG. 7. The opening 208 may have substantially the same center as the mask pattern 115.

According to this embodiment, the mask pattern 115 and the first mask layer 204 may correspond to a protruding portion P(60) of FIG. 5. Thus, the mask pattern 115 and the first mask layer 204 may correspond to an upper groove G2 of FIG. 6. The base plate 80 may be etched by a thickness T5 using the first mask layer 204 as a mask as shown in FIG. 20. The base plate 80 may have the protruding portion P(60) of FIG. 5 as shown in FIG. 20. The thickness T2 of the protruding portion P(60) may be the same as or different from the depth T5 of the upper groove G2. The base plate 80 may have the upper groove G2 of FIG. 6, which corresponds to the opening 208 of the first mask layer 204, as shown in FIG. 20.

Figure 21:
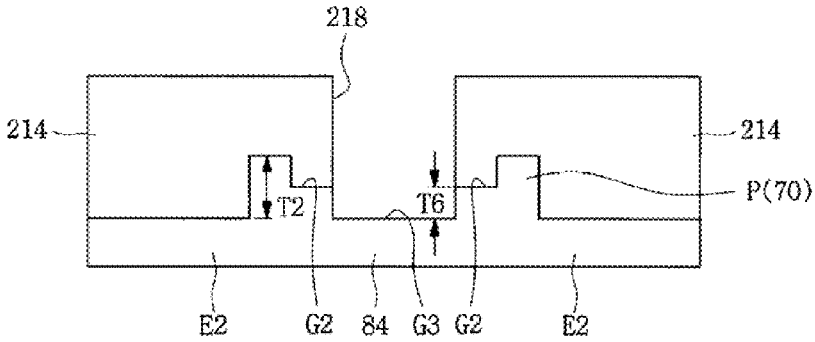

Referring to FIGS. 6 and 21, after the upper groove G2 is formed, the first mask layer 204 may be removed from the base plate 80. Subsequently, a second mask layer 214 may be formed on the base plate 80 as shown in FIG. 21. The second mask layer 214 may have a second opening 218, which exposes the base plate 80 and has substantially the same center as the first opening 208. Also, the second opening 218 may be formed as a smaller area than that of the first opening 218.

According to this embodiment, the base plate 80 may be etched by a thickness T6 using the second mask layer 214 as a mask as shown in FIG. 21. In this case, a mounting plate 84 may be formed under the second mask layer 214. The mounting plate 84 may have a lower groove G3 corresponding to the second opening 218 of the second mask layer 214. The depth T6 of the lower groove G3 may be the same as or different from the depth T5 of the upper groove G2. The mounting plate 84 may have a protruding portion P(70) of FIG. 6 as shown in FIG. 21.

According to this embodiment, the sum of the depths T5+T6 of the upper and lower grooves G2 and G3 may be the same as or different from the thickness T2 of the protruding portion P(70). The mounting plate 84 may have an extending portion E2, which contacts the protruding portion P(70) and extends from the bottom of the protruding portion P(70), as shown in FIG. 21.

Figure 22:
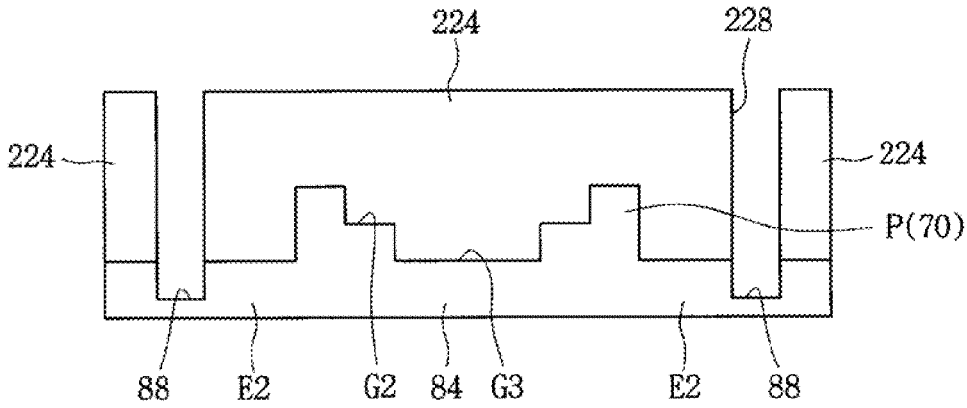

Referring to FIGS. 6 and 22, after the lower groove G3 is formed, the second mask layer 214 may be removed from the mounting plate 84. Thereafter, a third mask layer 224 may be formed on the mounting plate 84 as shown in FIG. 22. The third mask layer 224 may have at least one opening 228 exposing the extending portion E2 of the mounting plate 84. The mounting plate 84 may be partially etched using the third mask layer 224 as a mask, thereby forming at least one damp pattern 88 as shown in FIG. 22.

Figure 23:
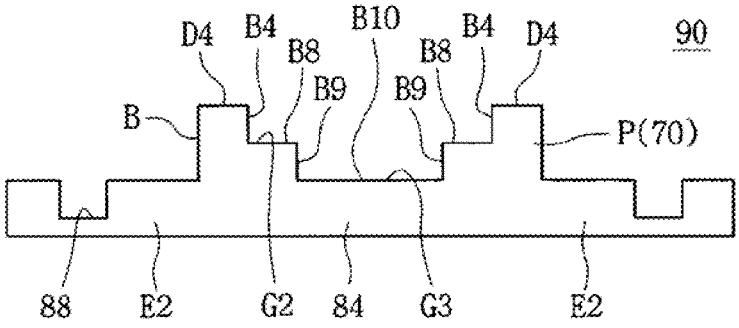

Referring to FIGS. 6 and 23, after the damp pattern 88 is formed, the third mask layer 224 may be removed from the mounting plate 84. In this case, the mounting plate 84 may have the protruding portion P(70) and the damp pattern 88 as shown in FIG. 23. According to a variation of this embodiment, the mounting plate 84 may have only the protruding portion P(70). More specifically, the protruding portion P(70) may have a top surface D4, an outer lateral surface B, an upper inner lateral surface B4, a connection surface B8, a lower inner lateral surface B9, and a bottom surface B10 as shown in FIG. 6.

According to this embodiment, the top surface D4 may be disposed at a height from the extending portion E2 and have a hole H2 as shown in FIG. 6. The outer lateral surface B may surround an outer edge of the top surface D4 as shown in FIG. 6. The upper inner lateral surface B4 and the connection surface B8 may define the upper groove G2, which is recessed downward from the top surface D4 having the hole H2, as shown in FIG. 6. The lower inner lateral surface B9 and the bottom surface B10 may define the lower groove G3, which is disposed under the upper groove G2, as shown in FIG. 6. The lower groove G3 may have a smaller aperture than that of the upper groove G2.

According to this embodiment, the upper inner lateral surface B4 may connect to an inner edge of the top surface D4. The connection surface B8 may connect the upper and lower inner lateral surfaces B4 and B9. The protruding portion P(70) may have a chip mounting portion C1 and a chip protection portion C2 defined by the top surface D4, the upper inner lateral surface B4, the connection surface B8, the lower inner lateral surface B9, and the bottom surface B10 as shown in FIG. 6. The chip mounting portion C1 may be formed on the bottom surface B10 of the protruding portion P(70). The chip mounting portion C1 may be formed substantially in the center of the bottom surface B10.

According to this embodiment, the chip protection portion C2 may be formed on the outer lateral surface B, the top surface D4, the upper inner lateral surface B4, the connection surface B8, and the lower inner lateral surface B9. Accordingly, the chip protection portion C2 may be formed in a peripheral region of the protruding portion P(70). The protruding portion P(70) and the damp pattern 88 may be formed in the mounting plate 84 and comprise the mounting package body 90 of FIG. 1. According to a variation of this embodiment, the mounting package body 90 may have only the protruding portion P(70).

According to a variation of this embodiment, the protruding portion P(70) of FIG. 6 may be separately formed and adhered onto the base plate 80. In this case, the base plate 80 may take the place of the mounting plate 84 of FIG. 1. Also, when pressure is applied to the covering and mounting package bodies 20 and 90 of FIG. 1, the chip protection portion C2 and/or the damp pattern 88 may appropriately control the flow of an adhesive (not shown) flowing out from a gap between the covering and mounting package bodies 20 and 90.

Figure 24:
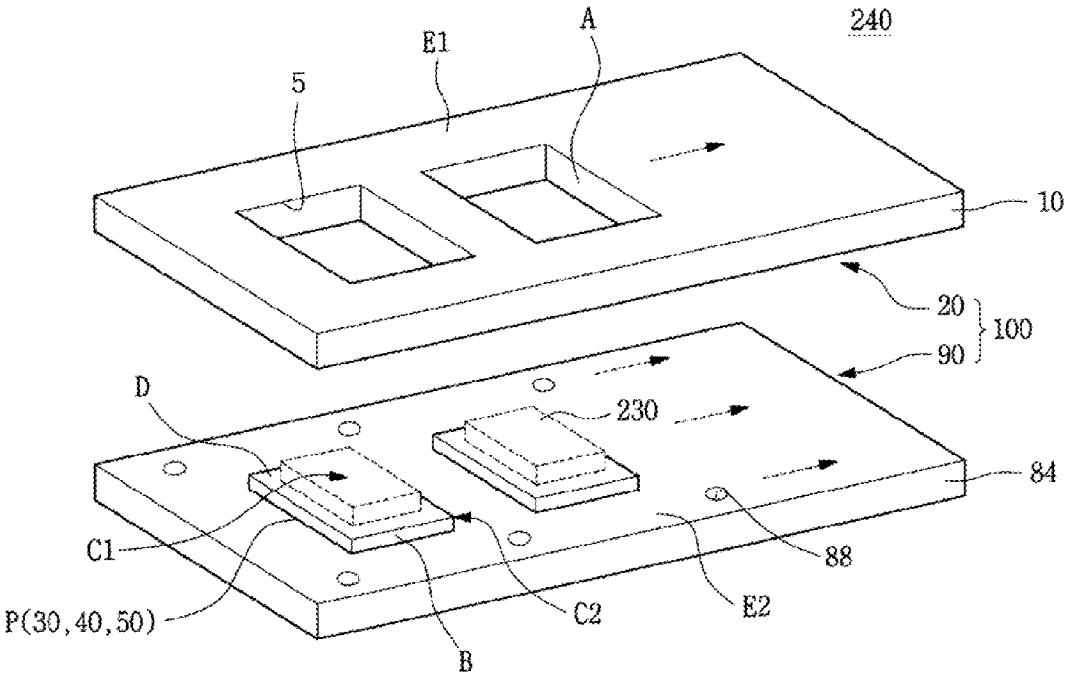
FIG. 24 is a schematic view of a biochip package including the biochip package body of FIG. 1, according to various exemplary embodiments of the invention.
Figure 25:
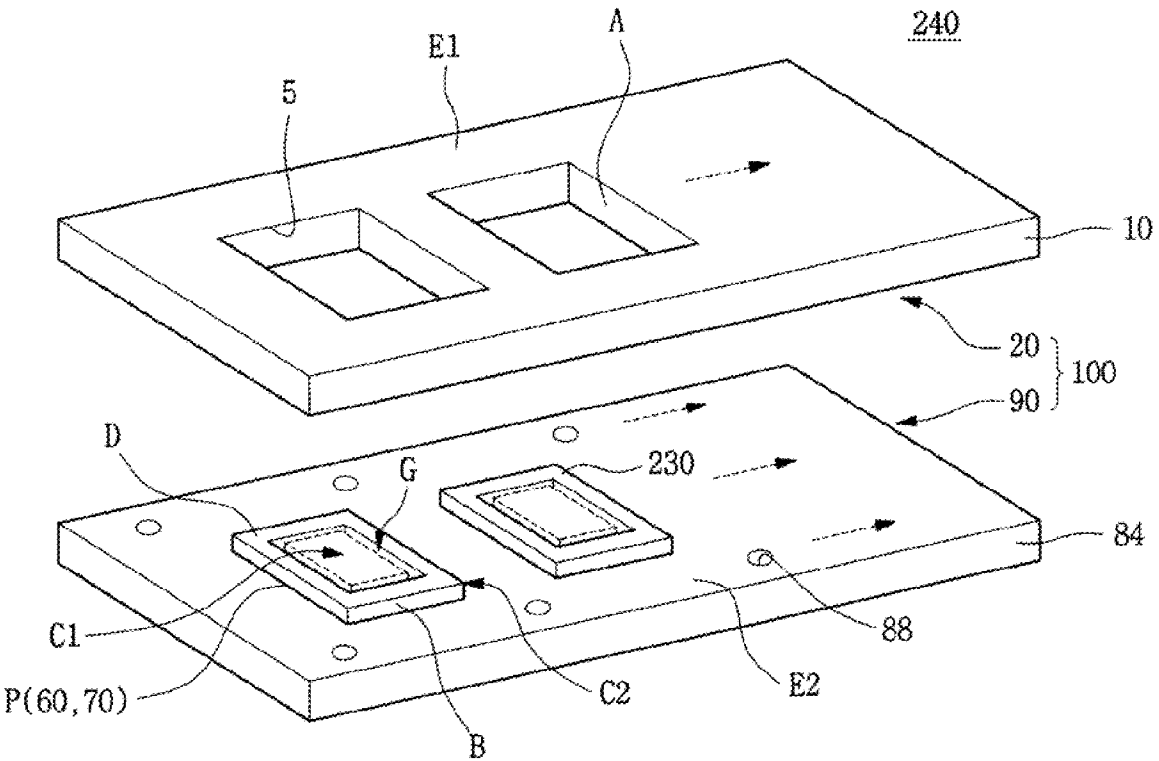
FIG. 25 is a schematic view of a biochip package including the biochip package body of FIG. 1, according to other exemplary embodiments of the invention.

Hereinafter, a biochip package according to exemplary embodiments of the invention will be described with reference to FIGS. 24 and 25. In FIGS. 24 and 25, the same reference numerals are used to denote the same materials and elements as in FIG. 1.

FIG. 24 is a schematic view of a biochip package including the biochip package body of FIG. 1, according to various exemplary embodiments of the invention.

Referring to FIG. 24, a biochip package 240 according to various exemplary embodiments of the invention may include a covering package body 20, a mounting package body 90, and a biochip 230. The covering package body 20 may have a covering plate 10. The covering plate 10 may include at least one landing window 5 and a peripheral portion E1 defining the landing window 5. The landing window 5 may have a guide surface A to penetrate the covering plate 10. The covering package body 20 may be disposed on the mounting package body 90. The mounting package body 90 may have a mounting plate 84.

According to the exemplary embodiments, the mounting plate 84 may have at least one protruding portion P and an extending portion E2 contacting the protruding portion P. The protruding portion P may be integrally formed with the mounting plate 84 and protrude from the mounting plate 84. Alternatively, the protruding portion P may be separately formed and adhered onto the mounting plate 84. According to an exemplary embodiment of the invention, the protruding portion P(30) may have a planar top surface D that faces the mounting plate 84 as shown in FIG. 2. According to another exemplary embodiment of the invention, the protruding portion P(40) may have a plurality of steps P1 and P2 disposed under a planar top surface D1 as shown in FIG. 3.

According to another exemplary embodiment of the invention, the protruding portion P(50) may have a top surface D2 obtained by forming an annular opening H1 in a planar surface, as shown in FIG. 4. According to the above-described exemplary embodiments of the invention, the biochip 230 may be disposed on the protruding portion P(30, 40, or 50). The biochip 230 may be either a deoxyribonucleic acid (DNA) chip or a protein chip. Accordingly, the biochip 230 may be formed on the protruding portion P(30, 40, or 50) and protrude from the protruding portion P(30, 40, or 50). As a result, when the covering and mounting packages 20 and 90 are adhered to an adhesive (not shown), the protruding portion P(30, 40, or 50) and the biochip 230 may be disposed opposite the guide surface A of the landing window 5.

According to exemplary embodiments of the invention, the protruding portion P(30, 40, or 50) and the biochip 230 may be exposed through the landing window 5. A chip protection portion C2 of the protruding portion P(30, 40, or 50) may be disposed at least under the biochip 230 and appropriately control the flow of the adhesive.

FIG. 25 is a schematic view of a biochip package including the biochip package body of FIG. 1, according to other exemplary embodiments of the invention.

Referring to FIG. 25, a biochip package 240 according to other exemplary embodiments of the invention may include a covering package body 20, a mounting package body 90, and a biochip 230. The biochip package 240 according to exemplary embodiments of the invention may have the same components as the biochip package 240 of FIG. 24 except for a protruding portion P(60 or 70). The protruding portion P(60 or 70) may have at least one groove G. More specifically, according to an exemplary embodiment of the invention, the protruding portion P(60) may have a single groove G2 formed in a planar top surface D3 as shown in FIG. 5. According to another exemplary embodiment of the invention, the protruding portion P(70) may have grooves G2 and G3, which are formed in a planar top surface D4 and provide sequentially smaller apertures, as shown in FIG. 6.

According to the exemplary embodiments, a biochip 230 may be disposed at the protruding portion P(60 or 70). Accordingly, the biochip 230 may be disposed in the protruding portion P(60 or 70). As a result, when the covering and mounting package bodies 20 and 90 are adhered to an adhesive (not shown), the protruding portion P(60 or 70) may be interposed between the biochip 230 and a guide surface A of a landing window 5. The protruding portion P(60 or 70) and the biochip 230 may be exposed through the landing window 5. A chip protection portion C2 of the protruding portion P(60 or 70) may be disposed at least adjacent to the biochip 230 and appropriately control the flow of the adhesive.

As described above, exemplary embodiments of the present invention provide a biochip package body having covering and mounting package bodies and a method of forming the biochip package body. In this case, unlike in the related art, the mounting package body may have at least one protruding portion that protrudes from a mounting plate. The protruding portion may prevent volume shifting of an adhesive flowing out from a gap between the covering and mounting package bodies. Also, a biochip may be disposed on the protruding portion. As a result, a biochip package including the biochip package body may be provided. The biochip package may inhibit the adhesive from contacting the biochip using the protruding portion. The biochip package may easily bring the biochip into contact with a test gene sample using the protruding portion.

While exemplary embodiments of the invention have been disclosed herein, it should be understood that other variations may be possible. For example, some or all of the above-described semiconductor devices may be replaced by other semiconductor devices, such as microprocessors or programmable logic chips. Such variations are not to be regarded as a departure from the spirit and scope of exemplary embodiments of the present application, and all such modifications as would be obvious to one skilled in the art are intended to be included within the scope of the following claims.

What is claimed is:

1. A biochip package body comprising a mounting package body including at least one protruding portion disposed on a mounting plate and an extending portion extending from a bottom of the at least one protruding portion, wherein the at least one protruding portion includes a chip mounting portion adapted for receiving a biochip and a chip protection portion, the chip mounting portion is disposed substantially in the center of the at least one protruding portion, the chip protection portion is disposed in a peripheral region of the at least one protruding portion, and the chip protection portion surrounds the chip mounting portion.

2. The biochip package body of claim 1, wherein the at least one protruding portion includes a top surface disposed at a height from the extending portion and a lateral surface surrounding an edge of the top surface, wherein the lateral surface contacts the extending portion, the chip mounting portion is disposed on the top surface, and the chip protection portion is disposed on the lateral surface.

3. The biochip package body of claim 1, wherein the at least one protruding portion includes a lower lateral surface, a connection surface, an upper lateral surface, and a top surface to have at least two steps, which are sequentially stacked to have sequentially smaller volumes upward from a main surface of the extending portion, the lower lateral surface and the connection surface defining a lower step, the upper lateral surface and the top surface defining an upper step, wherein the connection surface connects the lower and upper lateral surfaces, the chip mounting portion is disposed on the top surface, and the chip protection portion is disposed on the lower lateral surface, the connection surface, and the upper lateral surface.

4. The biochip package body of claim 1, wherein the at least one protruding portion includes a top surface disposed at a height from the extending portion and having an annular opening, an outer lateral surface surrounding an outer edge of the top surface, and inner lateral surfaces and a connection surface that define a groove recessed from the opening toward the mounting plate, the connection surface being interposed between the inner lateral surfaces, wherein the connection surface connects the inner lateral surfaces to each other, the inner lateral surfaces contact inner edges of the top surface, the chip mounting portion is disposed on a portion of the top surface surrounded by the annular opening, and the chip protection portion is disposed on the outer lateral surface, the remaining portion of the top surface disposed around the annular opening, the inner lateral surfaces, and the connection surface.

5. The biochip package body of claim 1, wherein the at least one protruding portion includes a top surface disposed at a height from the extending portion and having a hole, an outer lateral surface surrounding an outer edge of the top surface, and an inner lateral surface and a bottom surface recessed from the hole toward the mounting plate, wherein the inner lateral surface contacts an inner edge of the top surface, the chip mounting portion is disposed on the bottom surface, and the chip protection portion is disposed on the outer lateral surface, the top surface, and the inner lateral surface.

6. The biochip package body of claim 1, wherein the at least one protruding portion includes a top surface, an outer lateral surface, and an upper inner lateral surface, a connection surface, a lower inner lateral surface and a bottom surface to have at least two grooves including upper and lower grooves, which are recessed from a hole of the top surface toward the mounting plate and have sequentially smaller apertures, the top surface being disposed at a height from the extending portion and having the hole, the outer lateral surface surrounding an outer edge of the top surface, the upper inner lateral surface and the connection surface defining the upper groove, and the lower inner lateral surface and the bottom surface defining the lower groove, wherein the upper inner lateral surface surrounds an inner edge of the top surface, the connection surface connects the upper and lower inner lateral surfaces, the chip mounting portion is disposed on the bottom surface, and the chip protection portion is disposed on the outer lateral surface, the top surface, the upper and lower inner lateral surfaces, and the connection surface.

7. The biochip package body of claim 1, further comprising a covering package body adapted to be disposed on the mounting package body, and including at least one landing window disposed in a covering plate and positioned to expose the at least one protruding portion, and a peripheral portion surrounding the at least one landing window that corresponds to the extending portion of the mounting package body.

8. A biochip package comprising:

a mounting package body including at least one protruding portion disposed on a mounting plate and an extending portion extending from a bottom of the at least one protruding portion, wherein the at least one protruding portion includes a chip mounting portion adapted for receiving a biochip and a chip protection portion, the chip mounting portion is disposed substantially in the center of the at least one protruding portion, the chip protection portion is disposed in a peripheral region of the at least one protruding portion, and the chip protection portion surrounds the chip mounting portion;

a covering package body disposed on the mounting package body, and including at least one landing window disposed in a covering plate and exposing the at least one protruding portion and a peripheral portion surrounding the at least one landing window; and a biochip disposed on the chip mounting portion of the at least one protruding portion and exposed through the landing window of the covering package body.

9. The biochip package of claim 8, wherein the at least one protruding portion includes a top surface disposed at a height from the extending portion and a lateral surface surrounding an edge of the top surface, wherein the lateral surface contacts the extending portion, the chip mounting portion is disposed on the top surface, and the chip protection portion is disposed on the lateral surface.

10. The biochip package of claim 8, wherein the at least one protruding portion includes a lower lateral surface, a connection surface, an upper lateral surface, and a top surface to have at least two steps, which are sequentially stacked to have sequentially smaller volumes upward from a main surface of the extending portion, the lower lateral surface and the connection surface defining a lower step, the upper lateral surface and the top surface defining an upper step, wherein the connection surface connects the lower and upper lateral surfaces, the chip mounting portion is disposed on the top surface, and the chip protection portion is disposed on the lower lateral surface, the connection surface, and the upper lateral surface.

11. The biochip package of claim 8, wherein the at least one protruding portion includes a top surface disposed at a height from the extending portion and having an annular opening, an outer lateral surface surrounding an outer edge of the top surface, inner lateral surfaces and a connection surface that define a groove recessed from the annular openinghole toward the mounting plate, and the connection surface interposed between the inner lateral surfaces, wherein the connection surface connects the inner lateral surfaces to each other, the inner lateral surfaces contact inner edges of the top surface, the chip mounting portion is disposed on a portion of the top surface surrounded by the annular opening, and the chip protection portion is disposed on the outer lateral surface, the remaining portion of the top surface disposed around the annular opening, the inner lateral surfaces, and the connection surface.

12. The biochip package of claim 8, wherein the at least one protruding portion includes a top surface disposed at a height from the extending portion and having a hole, an outer lateral surface surrounding an outer edge of the top surface, and an inner lateral surface and a bottom surface recessed from the hole toward the mounting plate, wherein the inner lateral surface contacts an inner edge of the top surface, the chip mounting portion is disposed on the bottom surface, and the chip protection portion is disposed on the outer lateral surface, the top surface, and the inner lateral surface.

13. The biochip package of claim 8, wherein the at least one protruding portion includes a top surface, an outer lateral surface, and an upper inner lateral surface, a connection surface, a lower inner lateral surface and a bottom surface to have at least two grooves including upper and lower grooves, which are recessed from a hole of the top surface toward the mounting plate and have sequentially smaller apertures, the top surface being disposed at a height from the extending portion and having the hole, the outer lateral surface surrounding an outer edge of the top surface, the upper inner lateral surface and the connection surface defining the upper groove, and the lower inner lateral surface and the bottom surface defining the lower groove, wherein the upper inner lateral surface surrounds an inner edge of the top surface, the connection surface connects the upper and lower inner lateral surfaces, the chip mounting portion is disposed on the bottom surface, and the chip protection portion is disposed on the outer lateral surface, the top surface, the upper and lower inner lateral surfaces, and the connection surface.

14. The biochip package of claim 8, wherein the biochip includes one selected from a deoxyribonucleic acid (DNA) chip and a protein chip.

* * * * *